US006186338B1

(12) United States Patent
Douglas

(10) Patent No.: US 6,186,338 B1
(45) Date of Patent: Feb. 13, 2001

(54) SELF-PROPELLED MATERIAL-PROCESSING APPARATUS

(76) Inventor: Patrick Joseph Douglas, Southerlee, College Green, Castletown Ise of Man IM9 1BE (GB)

( * ) Notice: Under 35 U.S.C. 154(b), the term of this patent shall be extended for 0 days.

(21) Appl. No.: 09/180,123

(22) PCT Filed: Jan. 23, 1997

(86) PCT No.: PCT/GB97/00194

§ 371 Date: Jan. 4, 1999

§ 102(e) Date: Jan. 4, 1999

(87) PCT Pub. No.: WO97/41971

PCT Pub. Date: Nov. 13, 1997

(30) Foreign Application Priority Data

| | | |
|---|---|---|
| May 3, 1996 | (GB) | 9609365 |
| Oct. 24, 1996 | (GB) | 9622131 |
| Nov. 1, 1996 | (GB) | 9622762 |

(51) Int. Cl.[7] ..... B07B 1/49
(52) U.S. Cl. ..... 209/421; 209/241; 209/244
(58) Field of Search ..... 209/240, 241, 209/243, 244, 420, 421

(56) References Cited

U.S. PATENT DOCUMENTS

| | | | | |
|---|---|---|---|---|
| 4,948,299 | * | 8/1990 | Cronk, Jr. et al. | 209/421 X |
| 5,120,433 | | 6/1992 | Osadchuk | 209/421 X |
| 5,234,564 | * | 8/1993 | Smith | 209/241 |
| 5,577,618 | * | 11/1996 | Rafferty | 209/421 |

FOREIGN PATENT DOCUMENTS

| | | | | |
|---|---|---|---|---|
| 43 30246 | | 3/1995 | (DE) . | |
| 0344143 | | 9/1989 | (EP) . | |
| 0641607 | | 3/1995 | (EP) . | |
| 1553667 | * | 10/1979 | (GB) | 209/421 |
| 3-102002 | * | 4/1991 | (JP) | 209/421 |
| WO 85 03652 | | 8/1985 | (WO) . | |
| 0162792 | | 11/1985 | (WO) . | |
| WO 95 12462 | | 5/1995 | (WO) . | |
| WO 96 03225 | | 2/1996 | (WO) . | |

* cited by examiner

*Primary Examiner*—Tuan N. Nguyen
(74) *Attorney, Agent, or Firm*—Workman, Nydegger & Seeley

(57) ABSTRACT

A self-propelled material-processing apparatus (10) comprises a chassis (12), an engine (13) mounted on the chassis near the forward end thereof, and endless tracks (14) permanently supporting the chassis (12) and power-operated by the engine (13). A supply conveyor (18) has a material-receiving end (15) which projects forwardly of the forward end of the chassis (12) and an opposing upper discharge end (21). A material processing device (11), e.g., a screen box, is mounted directly or indirectly on the chassis (12) generally above the rear end of the chassis (12). The material processing device is arranged to receive material from the discharge end (21) and is configured for movement between an operative position and a transport position. The weight of the apparatus, when in the operative position, is generally balanced by the engine (13) and forward end (15) of the conveyor (18) at the forward end of the chassis and the screen (11) and discharge conveyor (121) at the rear of the chassis.

20 Claims, 11 Drawing Sheets

SELF-PROPELLED MATERIAL-PROCESSING APPARATUS

BACKGROUND OF THE INVENTION

1. Field of the Invention

This invention relates to a self-propelled material-processing apparatus.

2. Present State of the Art

It is known to provide self-propelled screening apparatus of the general type which comprise a chassis, a prime mover mounted on the chassis, moving means supporting the chassis and arranged to be power-operated by the prime mover in order to move the apparatus over the ground, a hopper arranged to receive a supply of bulk material to be screened by the apparatus, a conveyor arranged to receive material from the hopper and to convey such material to a discharge end of the conveyor, a screen arranged to receive material from the discharge end of the conveyor, and one or more discharge conveyors arranged to receive screened material from the screen and to discharge such material to a required deposition zone or zones, spaced outwardly of the chassis of the apparatus.

A self-propelled screening apparatus of the above general type may be used (a) to carry out screening operations on the move when it is required to form travelling deposits of screened material e.g. to fill-in a pipeline trench after laying of a pipeline, or to introduce hardcore or other foundation material to form the base of a road, or (b) to carry out static screening operations when required, but being capable of being moved from one position to another on a particular site when required.

A typical screening apparatus is of substantial overall length (when the component parts are deployed to screening and discharge positions), in that usually a hopper is arranged at one end of the chassis, a conveyor elevator extends lengthwise of the apparatus from the hopper to a discharge end above, or located outwardly of the opposite end of the chassis; and after material falls under gravity to the screen e.g. to a "screen box", and one (or more) discharge conveyor (which is arranged to receive screened material from the screen box) extends outwardly away from the chassis in order to deposit the screened material at a required deposition zone.

Discharge conveyors which may be used include so-called "tail conveyors", which discharge screened material rearwardly of the apparatus, and "side conveyors" which discharge the screened material laterally of the apparatus. Different discharge conveyors may be used to receive different screened "fractions" from the screen box, and to discharge such material to require deposition zones. A typical screening apparatus might have a single tail conveyor, and a pair of side conveyors, so that three different screened fractions or portions can be separated in the screen box, and discharged to separate discharge locations.

It is desirable for the apparatus to be easily manoeuvrable (in order to move from one static screening location to another, or to carry out screening operations "on the move"), and use of endless crawler tracks is therefore particularly suitable to form the moving means to propel, and to steer the apparatus. However, the length of a practical arrangement of endless tracks (to give required easy manoeuvrability) is much less than the overall length of the apparatus (when its component parts are deployed to screening/discharge positions), and in which they project outwardly of the chassis to substantial extents. This results in substantial inertial loads being generated when the apparatus is moving, and particularly when the apparatus is being steered. (This is somewhat similar to the inertial loads generated when an individual carries a horizontal ladder from a mid position and tries to rotate). It is therefore important to try, as far as possible, to maintain the overall centre of gravity of the apparatus (and its component parts) substantially centrally of the endless tracks, when in the deployed position.

In addition, endless track types of apparatus normally require to be transported on a "low loader", in order to move over the public highway from one site to another, and usually the component parts (and especially those which project from the chassis in the deployed position) must either be de-mounted, or else be moved to transport positions in which they at least reduce the extent of their projection from the chassis, before the apparatus can be transported on the low loader.

However, while the inertial loads of the deployed apparatus will be reduced, the much greater road speed of the low loader (compared with the self-propelled movement of a tracked apparatus in operation) means that any substantial mass of the apparatus (which is off-set from the centre of gravity of the apparatus) will apply substantial inertial load when the low loader goes around a bend of a road, or negotiates a roundabout.

This means that the apparatus must be very securely restrained when it is carried on a low loader, but even with such restraint, very substantial inertial loads generated when going round a bend in a road could still be very hazardous to other traffic, or may even result in the low loader being overturned e.g. if the low loader is towed around a roundabout at excessive speed.

OBJECTS AND BRIEF SUMMARY OF THE INVENTION

The present invention therefore has been developed primarily with a view to provide a self-propelled material-processing apparatus which is well balanced when the component parts are deployed to operative positions, but in which improved stowage of the component parts can be obtained (when these parts are adjusted to transport positions), in the sense that the component parts are located within, or closely adjacent to the external "envelope" of the apparatus as determined by the chassis on which the component parts are mounted.

By this means, reduction of inertial loads can be achieved, thereby contributing to a more stable (and therefore less hazardous) travelling condition, and also to provide an overall reduced cubic capacity.

According to one aspect of the invention there is provided a self-propelled material-processing apparatus.

Preferably, the discharge conveyor comprises a tail conveyor, and which has foldable portions which can be constrained to move between "in line" positions in which one portion extends beyond the other, to form the operative discharge position, and a folded position, in which one of the portions underlies the screen, and the other portion extends generally upwardly.

In order to give a balanced apparatus, when deployed to the operative screening/discharge mode, the chassis may project forwardly and rearwardly of the endless tracks, and in particular the hopper may be mounted on an outrigger arrangement, to project forwardly of the endless tracks, whereas the discharge conveyor, (when it takes the form of a tail conveyor), projects in an opposite direction from the opposite end of the chassis when in the deployed position.

This provides reasonable balance to the apparatus, but in order to locate the overall centre of gravity of the apparatus substantially centrally of the endless tracks, which is preferred, the prime mover e.g. a heavy duty diesel engine, may be mounted on the chassis forwardly of the centre of gravity, so as to assist in counter balancing the load of the tail conveyor, and also of the processing device, when in their deployed positions.

The material processing device may comprise: a screen; a crusher; or a combination of a crusher and a screen.

The screen may take the form of a so-called screen box, and preferably pivotally mounted on an upstanding support structure mounted at the rear end (opposite to the hopper end) of the chassis. The screen box may be carried by a pair of A-frames, mounted one on each side, and with the apex of each A-frame being pivotally mounted on the upstanding structure. Pivotal adjustment of the screen box therefore allows the screening angle of the deck or decks of the screen to be adjusted, to suit different types of material.

Preferably, the supply conveyor is pivotally connected to the screen box, at or near to its discharge end, so that the conveyor can also adjust its position automatically, with any adjustment in screening angle of the screen box, to maintain optimum discharge of material from the discharge end of the conveyor to the screen box.

Preferably, the supply conveyor is in two parts, hingedly connected together, so that the conveyor can be adjusted to a transport position, in which the height of the discharge end (which is usually the highest part of the conveyor) can be lowered for transport purposes.

The screen box also can be pivotally adjusted, (not only to vary the screening angle), but also to adjust the screen box to a lowered transport position, in which its height is reduced. This pivotal adjustment of the screen box to the transport position is preferably accompanied by automatic adjustment of the conveyor, which is connected thereto.

In this first aspect of the invention, it is preferred that the discharge conveyor is a tail conveyor. However, as an alternative, or addition, a discharge conveyor may be mounted on the chassis at one side thereof, and be capable of being adjusted between a deployed position, in which it extends laterally outwardly of the chassis, and having a receiving end which receives a screened fraction of material from the screen, and discharges it laterally to a required deposition zone.

The side conveyor may be adjustably mounted on one side of the chassis, in a manner disclosed in e.g. EP 0506812, and which enables the side conveyor to take up a transport position in which it extends closely along one side of the chassis, thereby to remain substantially within, or closely adjacent to the external "envelope" defined by the chassis.

Preferably, a self-propelled apparatus according to the invention comprises a screening apparatus and which may be used alone, or in conjunction with a further screening apparatus, so that several different screening functions can be achieved by a co-operating pair of self-propelled screening apparatus. This further screening apparatus may take any suitable form, to carry out preliminary screening of bulk material, and then to deliver this partly screened material to a material input of the screening apparatus according the invention.

This further screening apparatus may be of the general type disclosed in more detail and claimed in WO96/03225.

The hopper which is provided in an apparatus according to the invention may be a supply hopper, with or without a preliminary screening device; or a so-called "feed boot".

BRIEF DESCRIPTION OF THE DRAWINGS

Preferred embodiments of self-propelled material-processing apparatus according to the invention will now be described in detail, by way of example only, with reference to the accompanying drawings, in which.

DETAILED DESCRIPTION OF THE PREFERRED EMBODIMENT

Figure 1:
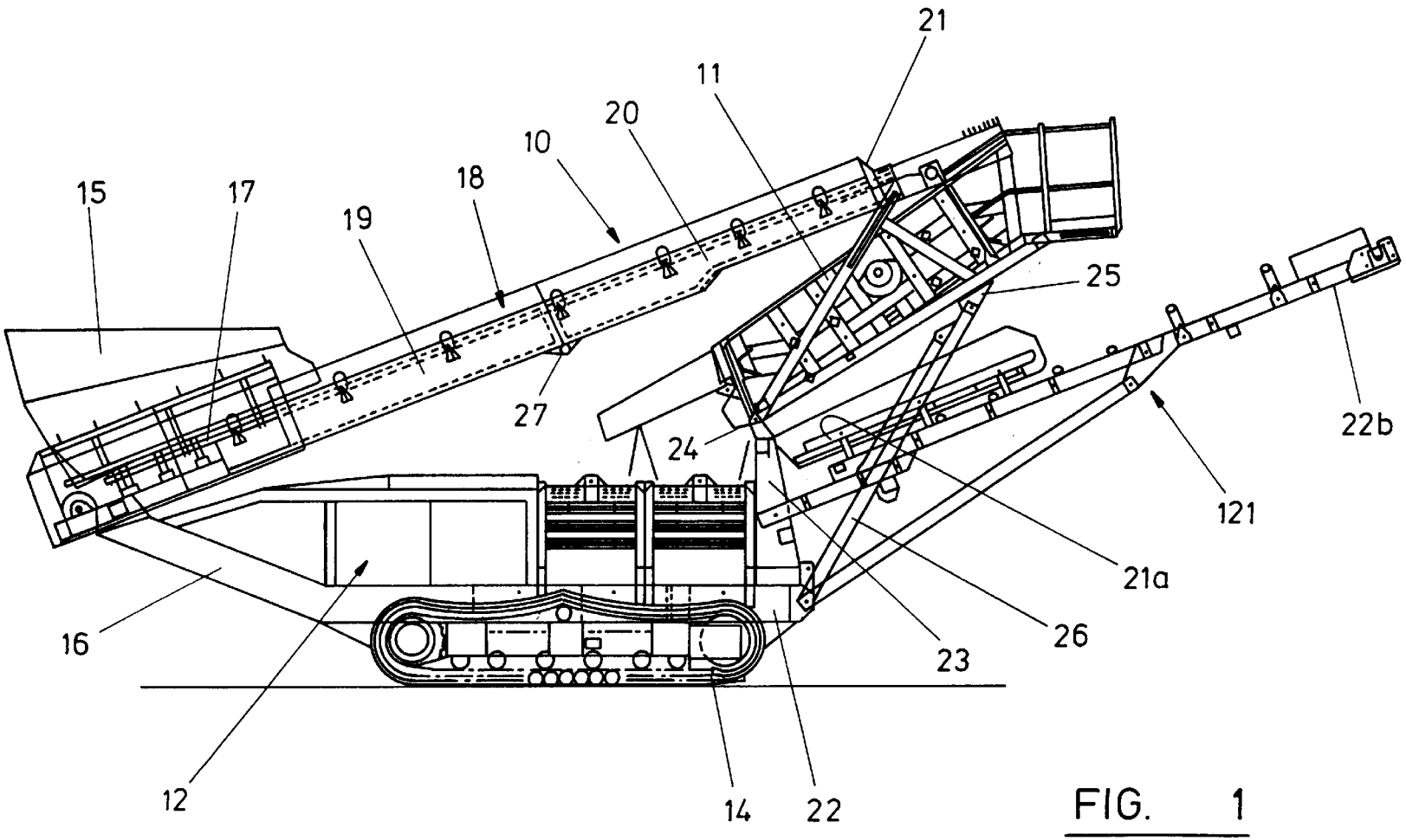
FIG. 1 is a side view of a first embodiment of screening apparatus, and showing the screening and discharge components thereof in one working or deployed position.
Figure 2:
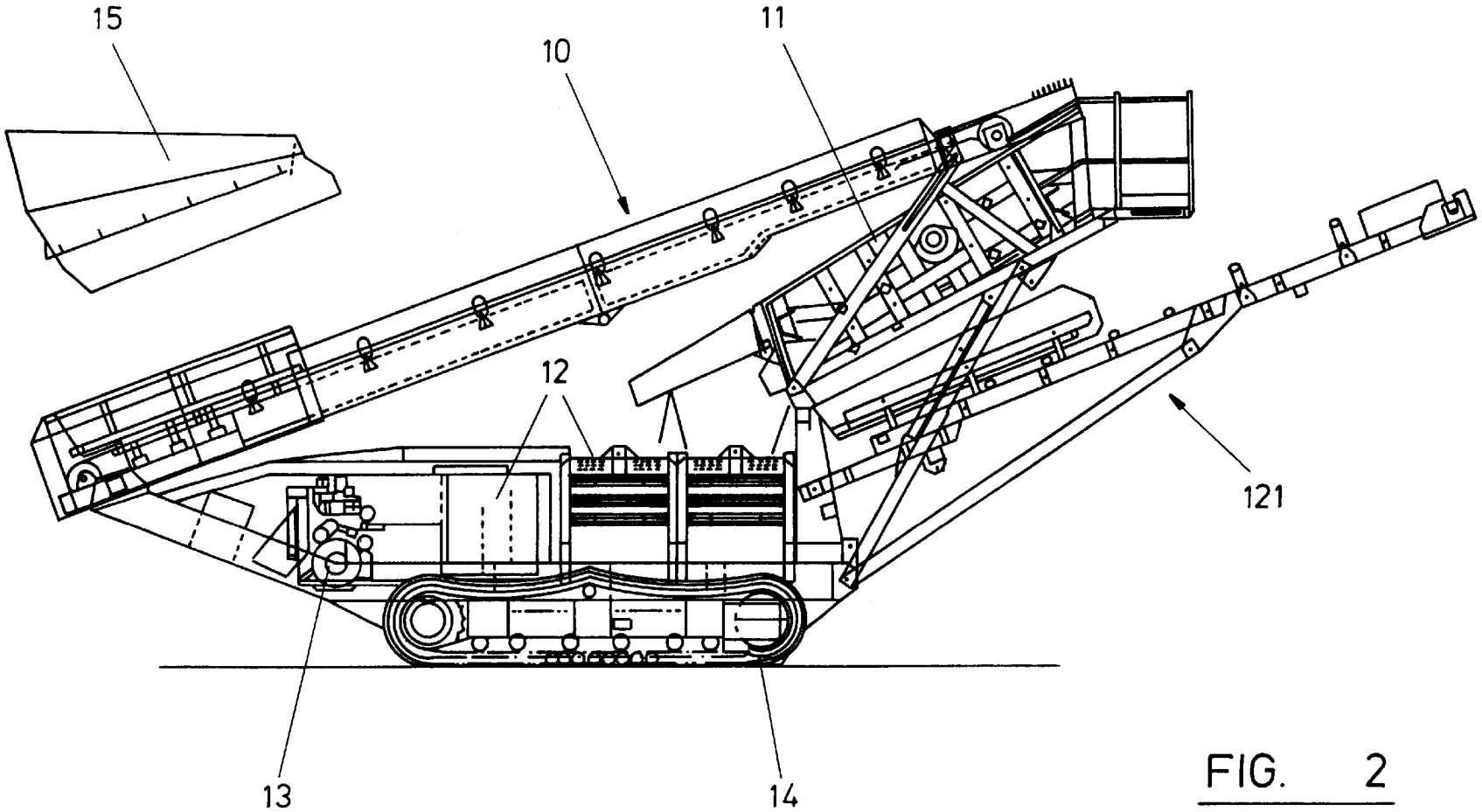
FIG. 2 is a side view, similar to FIG. 1, but showing the components in a further operative and deployed position.

Referring first to FIGS. 1 and 2 of the drawings, this shows a bulk material-processing apparatus according to the invention, and in the form of a self-propelled screening apparatus which is designated generally by reference 10, and in which a screen, in the form of a screen box 11, takes up a position of maximum screening angle in FIG. 1, and a position of minimum screening or working angle in FIG. 2. Adjustment of the screening angle is usually necessary, to suit different types of bulk material to be screened. The screen box 11 usually will have more than one separate screen "deck" so that different screened portions or fractions can be separated, and then discharged by respective discharge conveyors to required deposition zones spaced from the apparatus.

The apparatus 10 comprises a chassis 12, and a prime mover in the form of engine 13 (see FIG. 2) is mounted on the chassis 12 at or near a forward end thereof, and the purpose of this is to provide balance to the weight action of the components of the apparatus mounted, and projecting from the rearward end of the chassis 12, as will be described in more detail below. Moving means is provided to support the chassis 12, and to be power operated by engine 13, in order to move the apparatus over the ground. The preferred moving means comprises a pair of endless crawler tracks 14, which are of relatively short length, compared with the overall length of the apparatus, and which can propel the apparatus over difficult ground conditions in a typical site location, but which also gives the apparatus, (despite its overall length when in the deployed position) easy manoeuvrability by the steering action which can be achieved using endless crawler tracks.

A hopper 15 is mounted indirectly on the chassis 12 on a forward end of the chassis 12 via an outrigger 16, and the hopper 15 receives a supply of bulk material, and preferably includes some form of pre-screening apparatus e.g. a bar grizzly screen, to carry out a preliminary screening action on the bulk material, before it passes downwardly under gravity onto the lower receiving end 17 of a conveyor/elevator 18. The conveyor 18 is in two parts, hingedly connected together, namely lower part 19 which has the receiving end 17 to receive material from the hopper 15, and an upper part 20 having an upper discharge end 21 from which material can fall under gravity onto screen box 11. The "hopper" may also take the form of a so-called "feed boot", which is a type of mini-hopper or guide chute, which guides material from one end of a supply conveyor.

Figure 3:
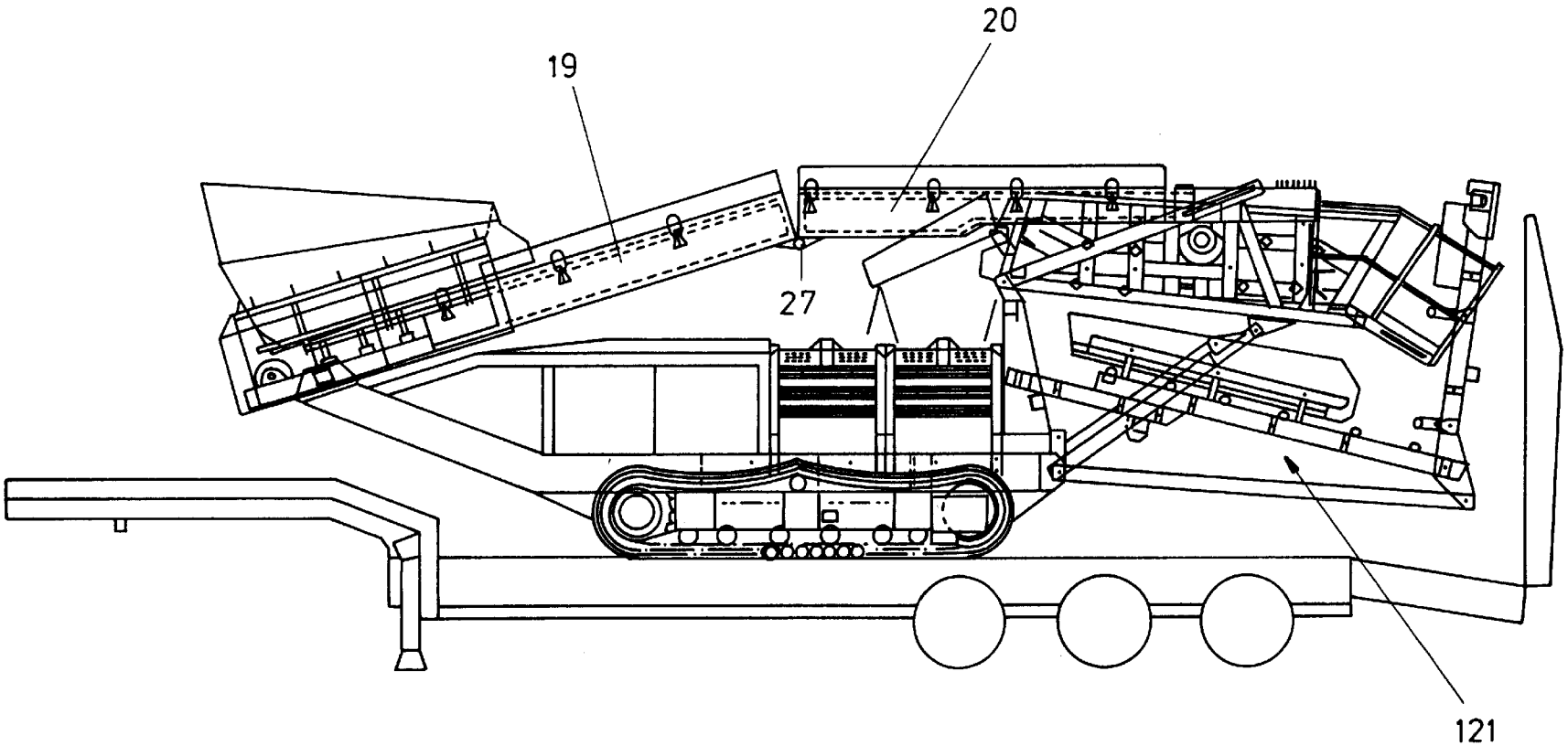
FIG. 3 is a side view of the apparatus, but showing the component parts adjusted to a stowage or transport position, in which the apparatus can be transported on a low loader trailer.
Figure 4:
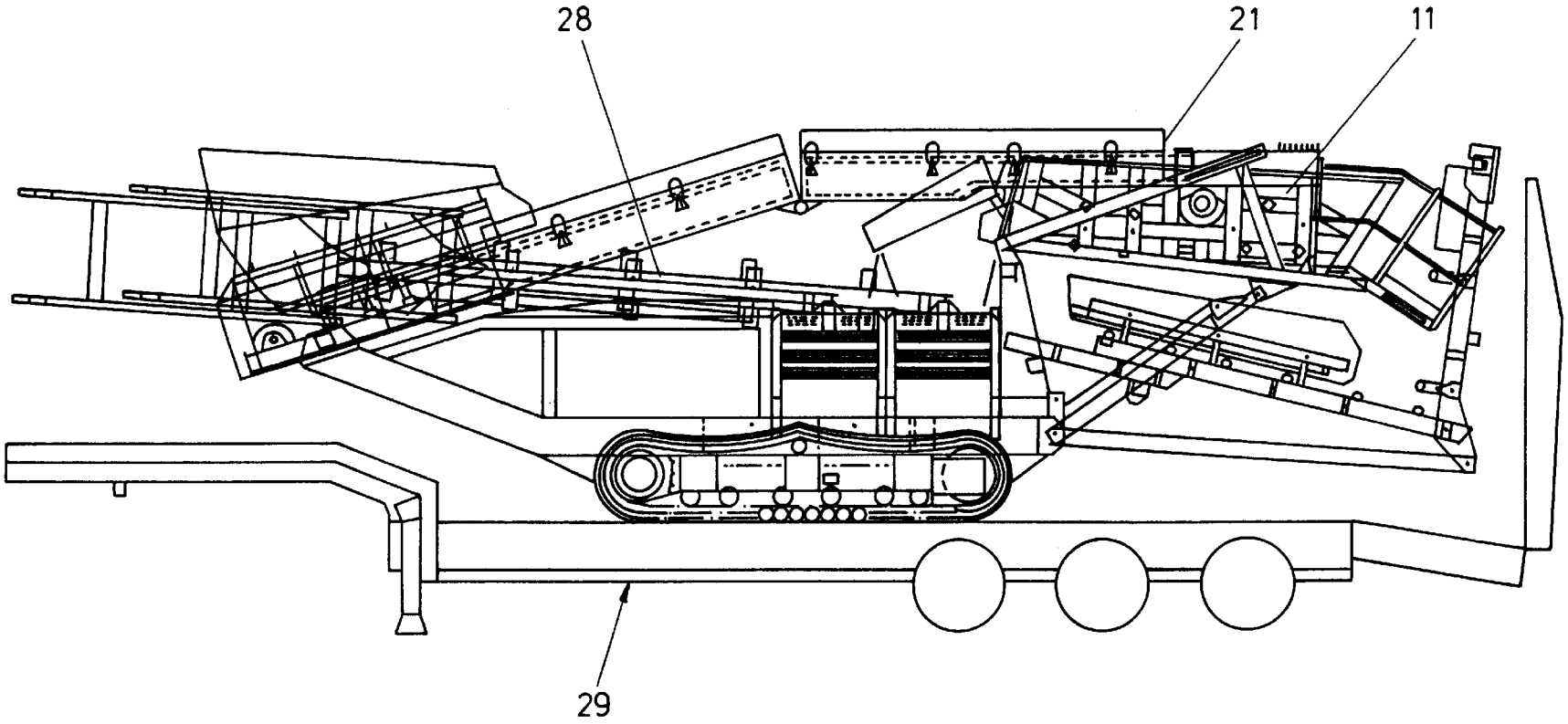
FIG. 4 is a view, similar to FIG. 3, but showing an additional discharge conveyor mounted thereon, and adjusted to take up a transport position.

A discharge conveyor 121, taken the form of a so-called "tail conveyor", is mounted on a rear end 22 of chassis 12, and is shown in the deployed position, in which it can receive screened material from the screen box 11 via its receiving end 21*a*, and to discharge such material rearwardly of the apparatus to a required deposition zone via its discharge end 21*b*. If the screening operation takes place while the apparatus is on the move, then a travelling deposit of screened material is formed. This might be suitable for in-filling of a pipeline trench. The tail conveyor 121 is foldable from the deployed position shown in FIGS. 1 and 2, to a transport position, as can be seen in FIGS. 3 and 4. The folding of the tail conveyor may he as disclosed in more detail in WO95/12462.

The screen box 11 is pivotally mounted on an upstanding support structure 23, at the rear end 22 of the chassis 12, by means of a horizontal pivot 24, and this allows the screen angle of the screen box 11 to be adjusted between the maximum screening angle shown in FIG. 1, to the minimum screening or working angle shown in FIG. 2. However, the screen box 11 can be pivoted still further downwardly, beyond the position shown in FIG. 2, in order to take up a transport position, as shown in FIGS. 3 and 4, in which the overall height of the screen box is reduced to a suitable level.

The screen box 11 is mounted on pivot 24 via a respective pair of A-frame structures 25, mounted one on each side of the screen box, with each A-frame structure being mounted on pivot 24 via the apex of the A-frame.

Adjustment of the angle of the screen box 11 about pivot 24 can be achieved by operation of a telescopic or other adjuster 26.

The discharge end 21 of the conveyor 18 (and in particular being provided at the upper end of the second part 20 of the conveyor 18) is pivotally connected to the screen box 11, conveniently by way of a pivot connection to the A frame structures, or other parts of the screen box, and this enables the position of the discharge end 21 of the conveyor 18 to adjust itself automatically to any adjustment in inclination of the screen box 11, to give optimum screening action. However, by providing hinge connection 27 between the parts 19 and 20 of the conveyor 18, this allows the conveyor 18 to automatically adjust itself to a transport position, when the screen box 11 is downwardly adjusted to the stowage or transport position shown in FIGS. 3 and 4, whereby the two parts 19 and 20 "break open", and allow the height of the discharge end 21 to be lowered, as can be seen clearly in FIGS. 3 and 4.

FIGS. 1 and 2 show a tail conveyor (121) only, but preferably, as an addition, or alternative, a side conveyor (or a pair of side conveyors, one mounted on each side of the chassis 12) may be provided, and which project laterally outwardly, generally perpendicularly of the longitudinal axis of the chassis 12, when in the deployed position, so as to discharge a separate fraction of screened material to a substantial distance to one side of the apparatus. The tail conveyor may be mounted on the side of the chassis in a suitable adjustable way, such that it can take up the deployed position, (not shown), or can be adjusted to a position extending alongside the chassis, so as to be generally within the "envelope" of the chassis when in the stowed position.

This is shown in FIG. 4 in which side conveyor 28 is shown after it has carried out a combined pivoting and rolling movement. The pivoting movement comprises pivoting about a generally upright axis, to move from the deployed position to the transport position, and at the same time carries out a generally rolling action about its general longitudinal axis, so that the support framework of the side conveyor 28 moves from a supporting position for the conveyor (usually a troughed belt conveyor), to a position in which the endless belt extends generally in a vertical plane, with the two side frame components located generally one above the other.

FIGS. 1 and 2 show the apparatus 10 in deployed operative positions, and FIGS. 3 and 4 show the screening and discharge components of the apparatus adjusted to stowage or transport positions, suitable for the apparatus to be carried on a low loader 29. As discussed in the introductory text of this case, it is important to bring the movable component parts to a transport position in which their masses are located as closely as possible to the centre of gravity of the apparatus, so as to minimise inertial loads which may be generated when the low loader 29 moves around a bend in a road, or goes around a roundabout. Therefore, the discharge conveyor 121 can take up the folded position, as shown in FIGS. 3 and 4, in which it is located substantially within the overall length (as seen in plan) of the apparatus, in the sense that it does not project beyond the screen box 11 when in the transport position. In addition, the side conveyor 28 takes up the transport position, closely alongside the chassis 12.

The apparatus 10 may carry out static screening operations, or carry out screening operations on the move, if required.

Figure 5:
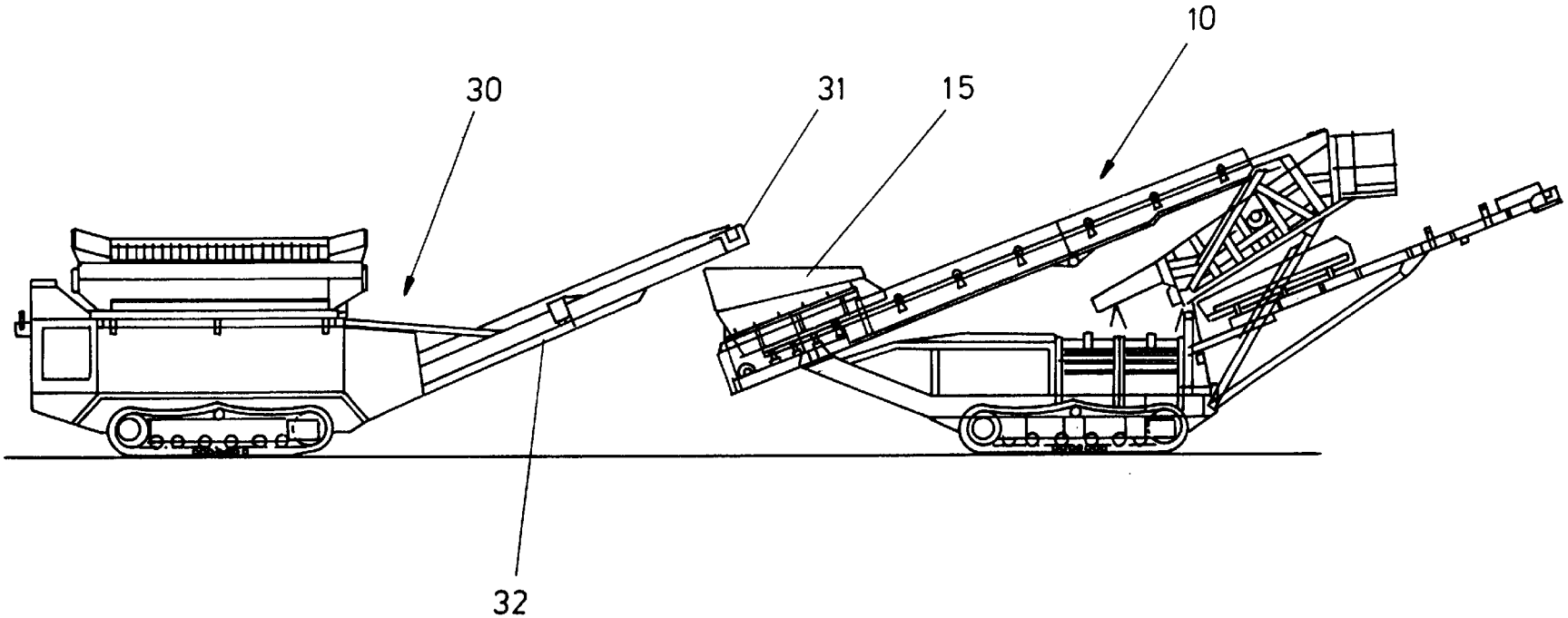
FIG. 5 is a side view showing the apparatus of FIGS. 1 to 4, taking up an operative position, and working in tandem with a further self-propelled screening apparatus, which carries out a preliminary screening action on bulk material, and supplies this partly screened material to an input hopper of the apparatus of FIGS. 1 to 4.

FIG. 5 shows an additional method of use of the apparatus of FIGS. 1 to 4, in that it shows apparatus 10 working in tandem with a second (pre-screening) self propelled screening apparatus 30. The screening apparatus 30 is self-propelled, and is capable of carrying out a preliminary screening action on bulk material, and then delivering this partly screened material via discharge end 31 of discharge conveyor 32 to the supply hopper 15 of apparatus 10. Screening apparatus 30 may take any suitable form, but preferably comprises the apparatus described in detail and claimed in WO96/03225.

The apparatus 10 has a pivot and slider joint operated by a ram in order to adjust the height of a head drum of the supply conveyor 18 relative to the screen, as well as allowing the conveyor to fold down to a required travelling height.

Low level and high level hopper feed boots may be provided, and depending on the application, the top hopper feed boot may be removable.

Figure 6:
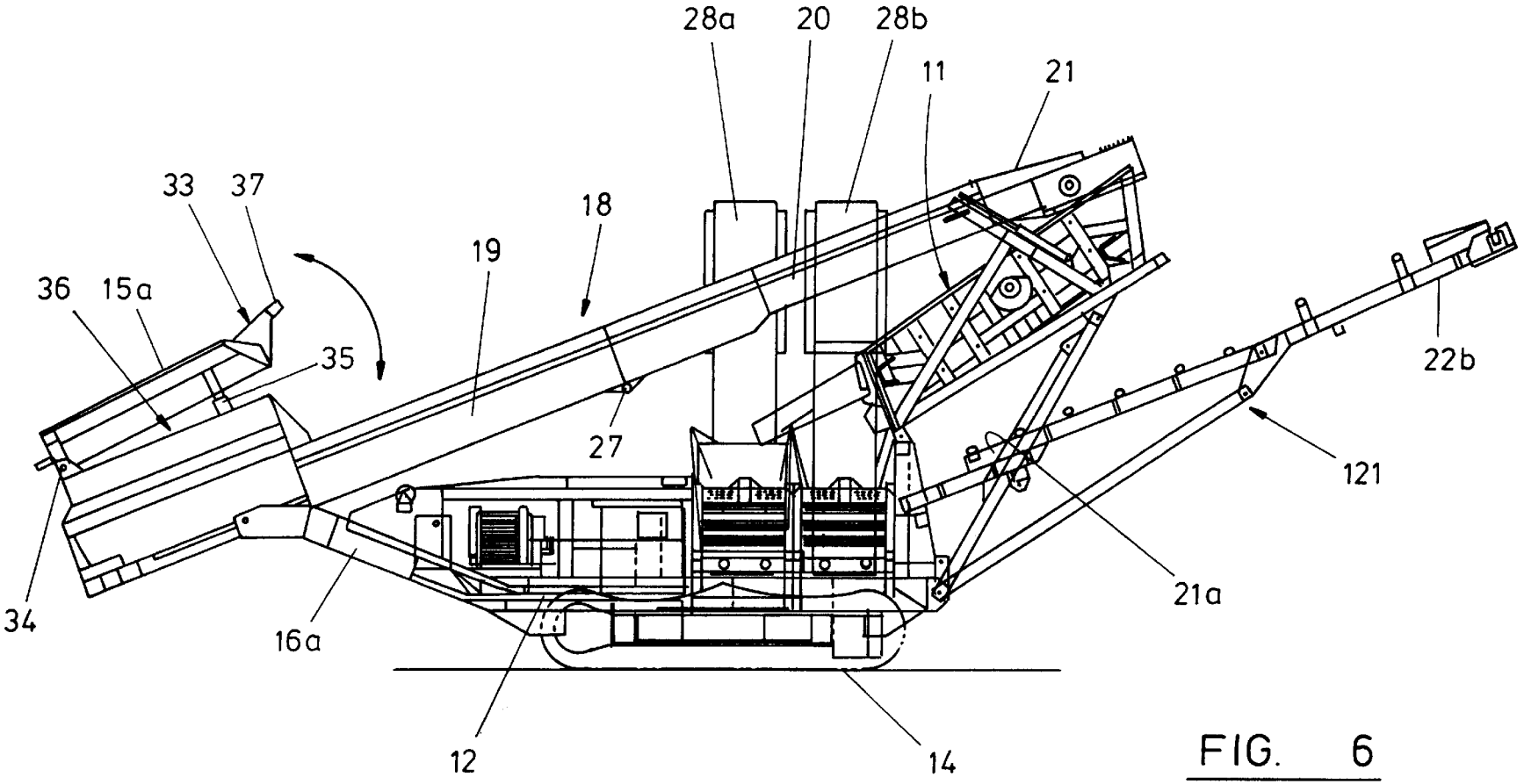
FIG. 6 is a side view of a second embodiment of self-propelled screening apparatus according to the invention, and with the operating components show in their deployed operative positions.
Figure 7:
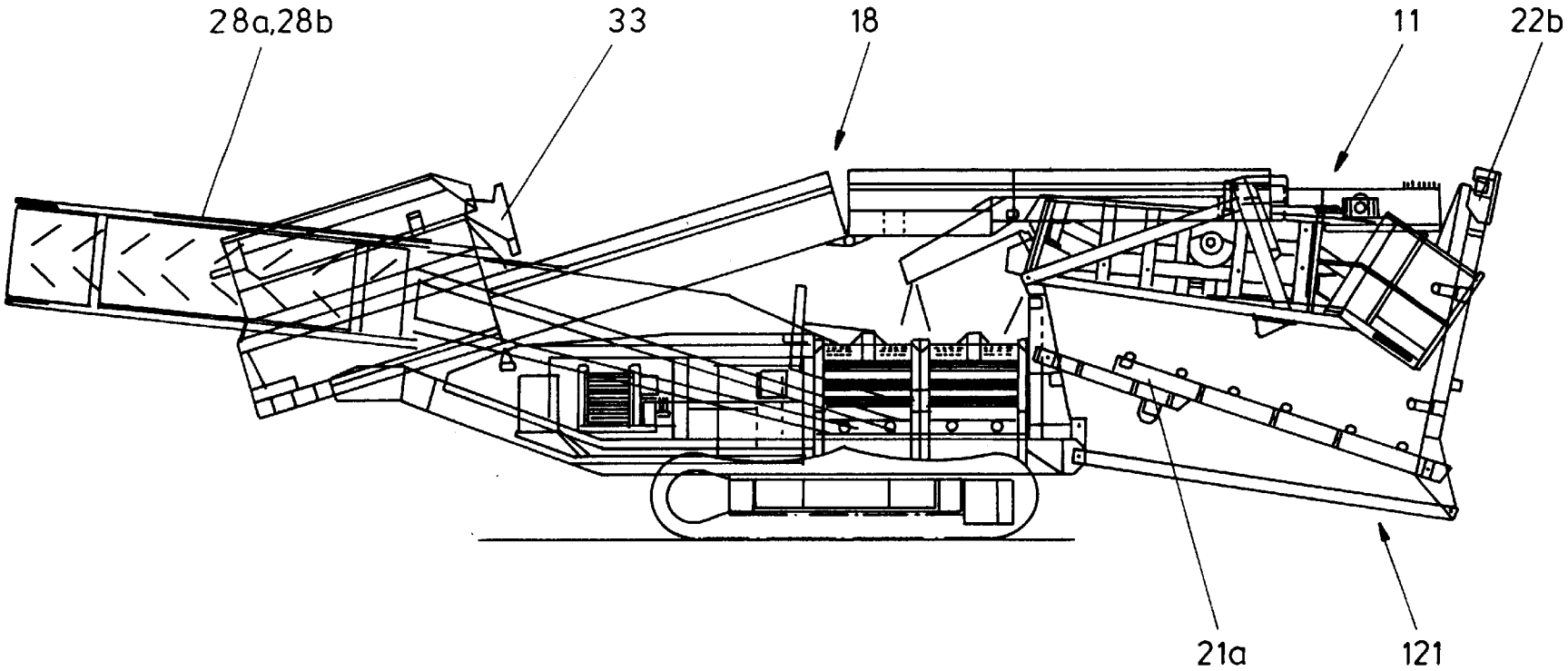
FIG. 7 is a side view, similar to FIG. 6, but showing the operating components adjusted to transport positions.
Figure 8:
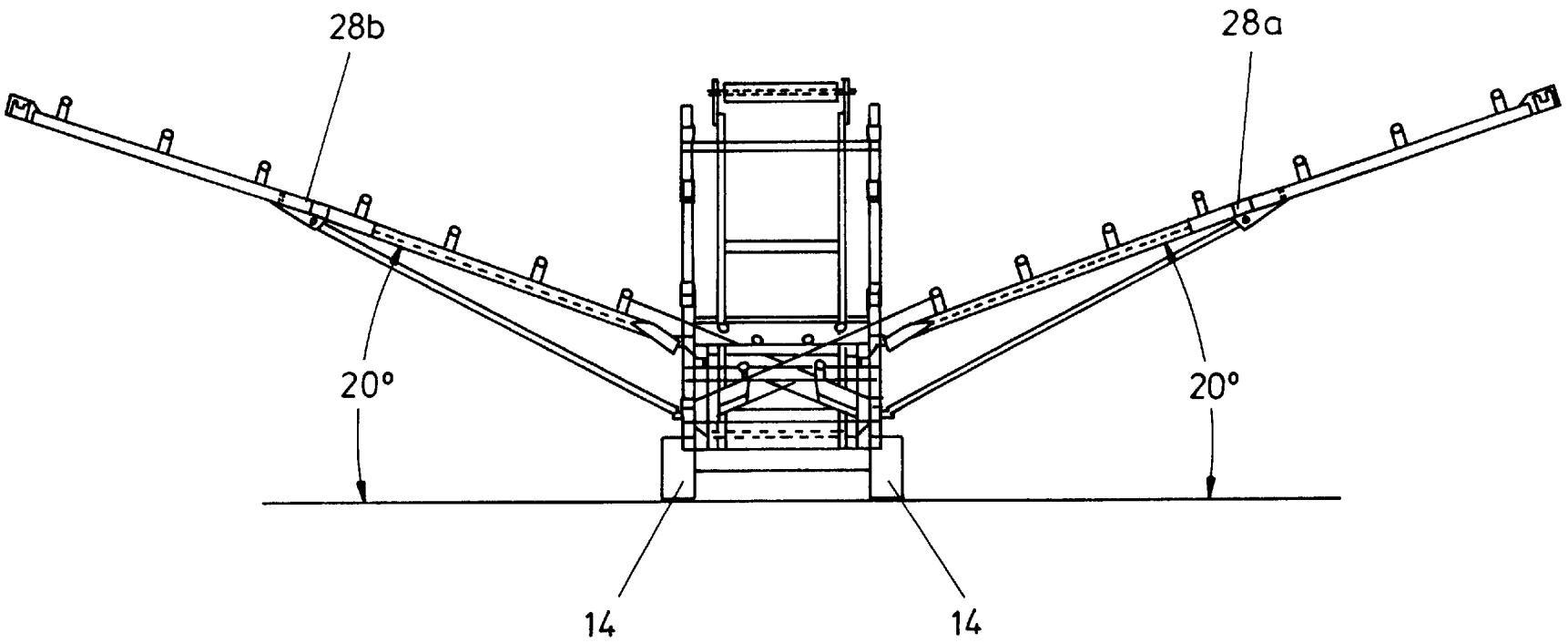
FIG. 8 is a rear view of the second embodiment of apparatus, with side-mounted discharge conveyors shown in operative discharge positions.
Figure 9:
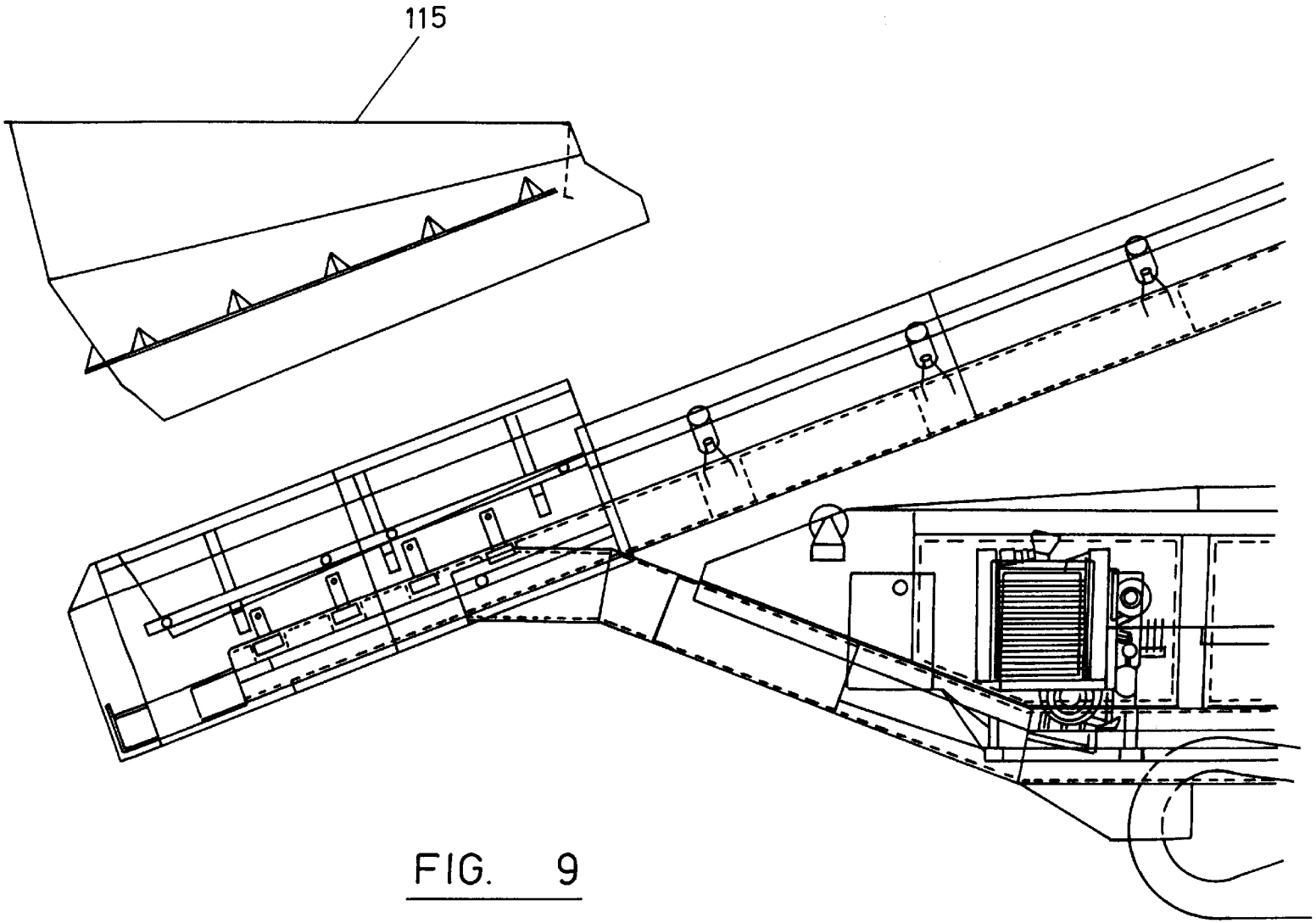
FIG. 9 is a detailed view of a modification to the forward end of the apparatus.

Referring now to FIGS. 6 to 8 of the drawings, a further embodiment is illustrated, and parts corresponding with those already described are given the same reference numerals, and will not be described in detail again. In addition to the rear discharge conveyor 121, taking the form of a so-called "tail conveyor", side mounted discharge conveyors 28*a* and 28*b* are mounted each on a respective side of the chassis, and are operative to discharge screened fractions of material from the screen box 11 to opposite sides of the apparatus. FIG. 8 shows the side conveyors 28*a* and 28*b* deployed to their operative positions. Discharge chutes collect screened fractions of material from the screen box 11, and distribute these separate screened portions to respective side conveyors, for lateral discharge onto stockpiles, one on each side of the apparatus.

At the forward end of the apparatus, an alternative arrangement of supply hopper is shown, which is mounted at the forward and lower end of the supply conveyor 18, and is supported on modified outrigger 16*a* which projects forwardly from the chassis 12. The modified hopper arrangement includes an adjustable guide chute 15*a*, which is upwardly and downwardly adjustable about a forward pivot mounting 34 by means of adjustable legs 35. A flexible skirt 36 projects downwardly of the chute arrangement 15*a*, to assist in the guidance of material to the lower supply end of the supply conveyor 18. A spill plate arrangement is provided at the rear end of the chute arrangement 15*a*, and is designated generally by reference 33. This serves to retain material which is fed into the chute arrangement, and to allow it to pass downwardly through preliminary screening e.g. bar grizzly screens, onto the supply end of the conveyor 18. The spill plate 33 has a grab hook 37, which can be engaged e.g. by an excavator, to apply linear displacement to the supply conveyor 18, and thereby to cause automatic adjustment of the screen angle of the decks of the screen box 11.

FIG. 7 shows the spill plate 33 downwardly adjusted to a transport position, and also shows the other operating components of the screening apparatus adjusted to transport positions, namely supply conveyor 18, screen box 11, rear discharge conveyor 121 and side conveyors 28*a* and 28*b*.

Figure 10:
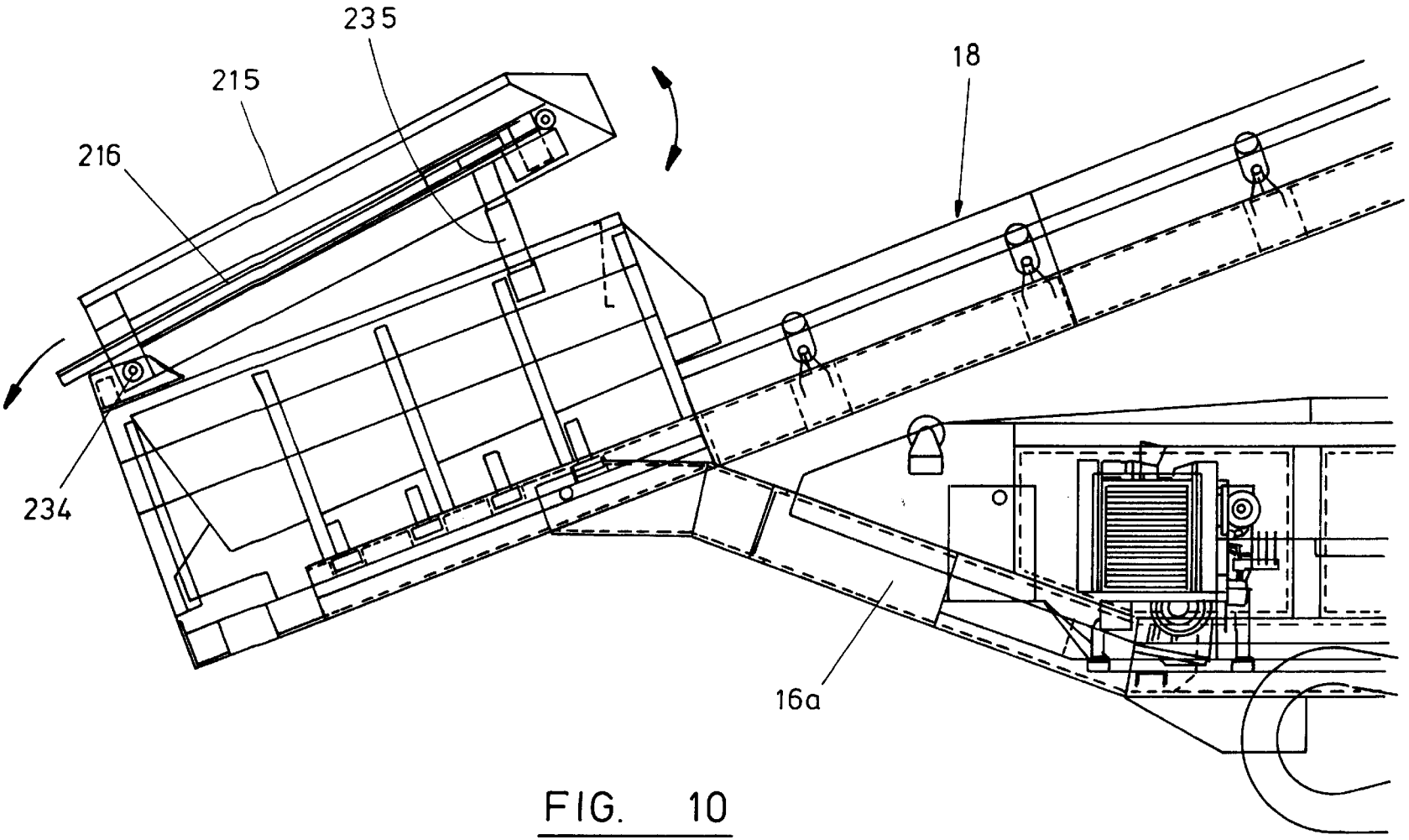
FIG. 10 is a detailed side view, similar to FIG. 9, showing a further modification; and, FIG. 11 is a side view, to an enlarged scale, showing an alternative means of supporting a screen, and supply conveyor coupled therewith, at the rear end of the chassis of the apparatus.
Figure 11:
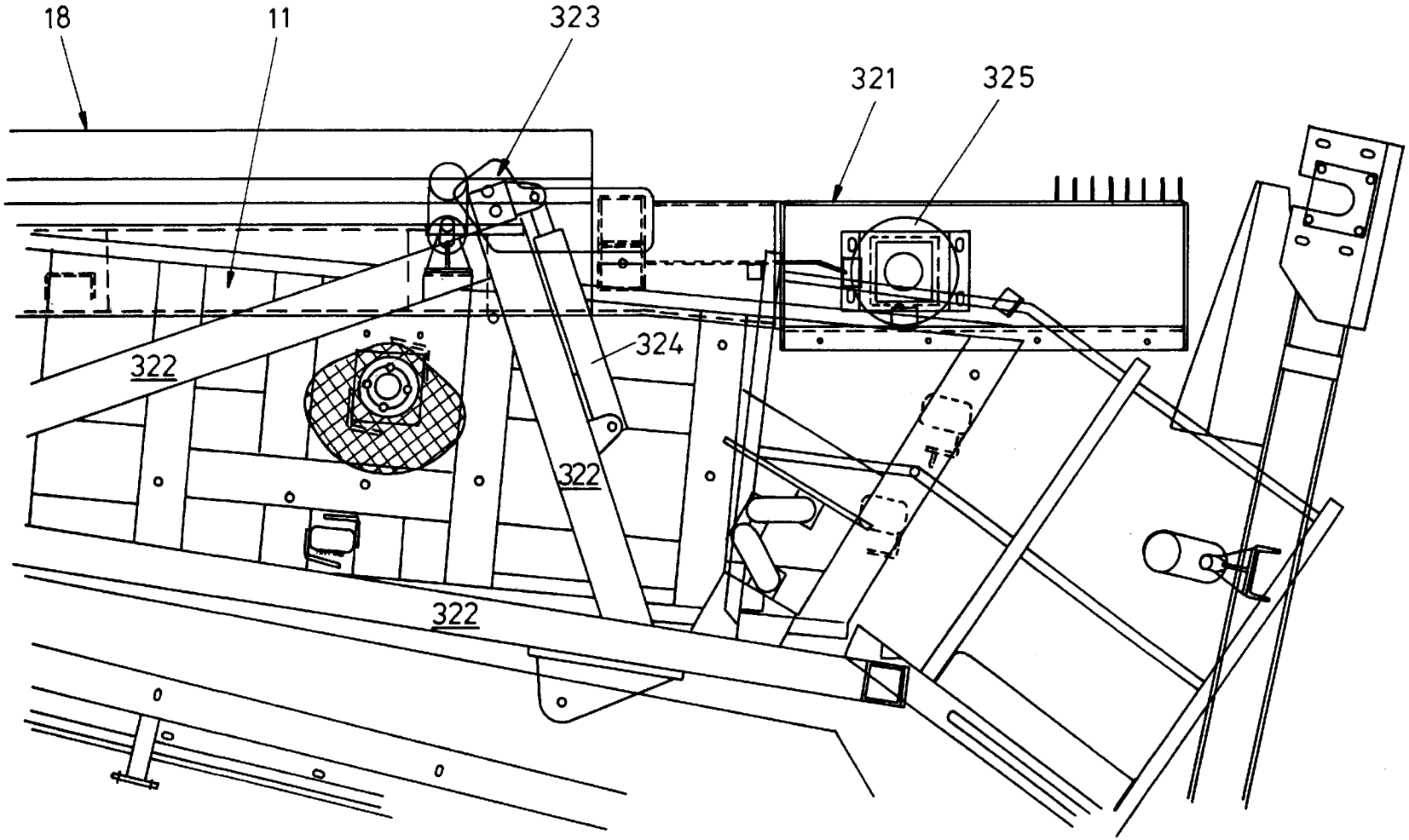

FIG. 10 is a detailed view, to an enlarged scale, of generally similar supply hopper arrangement to that shown in FIGS. 6 and 7, and which includes pivotally adjustable supply chute arrangement 215, upwardly and downwardly adjustable by support legs 235 for adjustment about rear pivot 234. When the supply chute arrangement 215 incorporates grid bars e.g. a bar grizzly screen, this can carry out a preliminary screening operation on the bulk material supplied to the apparatus, so that excessively large material e.g. large boulders, tree roots etc, can be retained on the grid bars, and then be discharged under gravity in a forward direction. This discharge may be assisted by upward adjustment, at periodic intervals, of the legs 235. The grid bars are shown-by reference 216 in FIG. 10. The guide chute arrangement 215 can be fitted in position, to replace a two stage feed boot arrangement, when a screening application requires the product to be screened by grid bars. Finally, FIG. 11 is a side view, to an enlarged scale, showing a modified arrangement, in accordance with the invention, whereby the upper discharge end 321 of the supply conveyor 18 is adjustably supported to the A-frame support structure 322 of the screen box 11 by a telescopic leg 323, whose leg length is controlled by operating cylinder 324.

This telescopic adjustment is provided for two reasons: first of all, it allows adjustment of the height of a head drum 325 of the supply conveyor 18, relative to the screen box 11 during operation, when required; and secondly it allows the supply conveyor 18 to be pulled downwardly and partly into the body of the screen box 11, for transport purposes, and especially for transportation on a low loader trailer.

Although not shown, preferably the apparatus is arranged to be capable of being remote controlled in its operation of the screening and discharge functions and/or of its movement over the ground also.

This may be advantageous in allowing the operator of a separate piece of equipment e.g. a dump truck or a shovel loader (which co-operates with the apparatus) to carry out remote operation of the apparatus. This may be necessary to move the apparatus to a more suitable position to receive bulk material and/or to a new position for discharge of screened material.

The supply hopper may incorporate static grid bars, to carry out preliminary screening action, or may incorporate a vibratory screen and vibratory screen grid bars.

Although the described embodiments of the invention comprises self-propelled screening apparatus, it should be understood that the invention may be applied to other types of bulk material processing apparatus. By way of example, the screen may be replaced by a crusher; or a combination of a crusher and a screen.

What is claimed is:

1. A self-propelled material-processing apparatus comprising:

a chassis having a first end and an opposing second end;

a prime mover mounted on the chassis;

a pair of endless crawler tracks solely supporting the chassis on a ground surface and arranged to be directly power-operated by the prime mover in order to move the apparatus over the ground;

a supply conveyor having a first end with a hopper disposed thereat, the hopper being located off of the ground surface for receiving the material, the supply conveyor conveying such material to a discharge end of the supply conveyor, the hopper being arranged at or near to the first end of the chassis, the discharge end of the supply conveyor being located above, or outwardly beyond the second end of the chassis;

a material-processing device positioned at or near to the second end of the chassis and arranged to receive material from the discharge end of the supply convey; and, a discharge conveyor adjustably mounted on the chassis for movement between an operative position and a transport position, the discharge conveyor having a receiving end to receive processed material and a discharge end to discharge such material to a required deposition zone spaced from the chassis when the discharge conveyor is in the operative position, the discharge conveyor being adjustable so as to reduce the overall length of the apparatus, when measured in the direction between the first and second ends of the chassis.

2. An apparatus according to claim 1, in which the discharge conveyor comprises a tail conveyor having foldable portions which can be constrained to move between "in line" positions in which one portion extends beyond the other to form the operative discharge position, and a folded position, in which one of the portions underlies the processing device, and the other portion extends generally upwardly.

3. An apparatus according to claim 1 in which the hopper comprises a feed boot.

4. An apparatus according to claim 1, in which the hopper incorporates grid bars to carry out a preliminary screening action on the bulk material supplied to the hopper.

5. An apparatus according to claim 4, in which the grid bars are vibratory screen bars.

6. An apparatus according to claim 1, in which the material-processing device comprises a screen box which is pivotally mounted on an upstanding support structure mounted at the rear end of the chassis.

7. An apparatus according to claim 6, in which the screen box is carried by a pair of A-frames, mounted one on each side, and with the apex of each A-frame being pivotally mounted via pivot to the upstanding structure.

8. An apparatus according to claim 6, in which the supply conveyor is pivotally connected to the screen box, at or near to its discharge end, so that the supply conveyor can also adjust its position automatically, with any adjustment in screening angle of the screen box, to maintain optimum discharge of material from the discharge end of the supply conveyor to the screen box.

9. An apparatus according to claim 1, in which the supply conveyor is in two parts, hingedly connected together at a hinge, so that the conveyor can be adjusted to a transport position, in which the height of the discharge end can be lowered for transport purposes.

10. An apparatus according to claim 7, in which the screen box is pivotally adjustable to a lowered transport position, in which its height is reduced, and the coupling of the supply conveyor to the screen box is such that adjustment of the screen box to the transport position is accompanied by automatic adjustment of the conveyor also to a transport position.

11. An apparatus according to claim 1, in which an additional discharge conveyor is mounted on one side of the chassis, and is adjustable between an operative position in which it extends laterally outwardly of the chassis, and a stowed transport position in which it extends along one side of the apparatus.

12. An apparatus according to claim 11, including a pair of side discharge conveyors, each mounted on a respective side of the chassis.

13. An apparatus according to claim 1, including means for remote controlling the operation of the apparatus.

14. An apparatus according to claim 1, in which the bulk-material processing device comprises a crusher, or a combination of a crusher and a screening device.

15. An apparatus according to claim 1, wherein the hopper is directly mounted over the receiving end of the supply conveyor.

16. A self-propelled material-processing apparatus comprising:

a chassis having a first end and an opposing second end;

a prime mover mounted on the chassis;

a pair of endless crawler tracks solely supporting the chassis on a ground surface and arranged to be directly power-operated by the prime mover in order to move the apparatus over the ground;

a supply conveyor having a first end with a hopper disposed thereat, the hopper being located off of the ground surface for receiving the material, the supply conveyor conveying such material to a discharge end of the supply conveyor, the hopper being arranged at or near the first end of the chassis, the discharge end of the supply conveyor being located above, or outwardly beyond the second end of the chassis;

a material-processing device mounted directly or indirectly on the chassis and arranged to receive material from the discharge end of the supply conveyor, the processing device being arranged at or near to the second end of the chassis; and a discharge conveyor adjustably mounted on the chassis for movement between an operative position and a transport position, the discharge conveyor having a receiving end to receive processed material and a discharge end to discharge such material to a required deposition zone spaced from the chassis when the discharge conveyor is in the operative position, the discharge conveyor being adjustable to a stowed transport position in which the discharge conveyor extends along one side of the apparatus.

17. A self-propelled material-processing apparatus which comprises:

a chassis having forward and rear ends;

a prime mover mounted on the chassis;

moving means permanently and solely supporting the chassis on a ground surface and arranged to be directly power-operated by the prime mover in order to move the apparatus over the ground;

a supply conveyor having a first end with a hopper disposed thereat, the hopper being located off of the ground surface for receiving the material, the supply conveyor conveying such material to a discharge end of the conveyor;

a material-processing device mounted directly or indirectly on the chassis and arranged to receive material from the discharge end of the supply conveyor; and, a discharge conveyor adjustably mounted on the chassis at or near the rear end thereof, for movement between an operative position and a transport position, and having a receiving end to receive processed material and a discharge end to discharge such material to a required deposition zone spaced from the chassis when in its operative position;

furthermore:

(a) a pair of endless crawler tracks form the moving means;

(b) the receiving end of the supply conveyor is arranged at, or forwardly of the forward end of the chassis, and the discharge end of the supply conveyor is located at, or rearwardly of the rear end of the chassis;

(c) the processing device is arranged at or near to the rear end of the chassis; and (d) in order to take-up the transport position, the discharge conveyor is adjustable so as to reduce the overall length of the apparatus, when measured in the direction between the forward and rear ends of the chassis.

18. An apparatus according to claim 17, in which the receiving end of the supply conveyor is mounted on an outrigger arrangement of the chassis and, which projects forwardly of the endless tracks, and which is partly balanced by the rearward projection of the discharge conveyor from the rear end of the chassis, when in its operative position.

19. An apparatus according to claim 17, in which the prime mover is mounted at or near the forward end of the chassis, to assist in counterbalancing the load of the processing device, and the discharge conveyor when in its operative position.

20. An apparatus according to claim 19, in which the hopper is mounted on the outrigger arrangement.

* * * * *